US007367085B2

(12) United States Patent
Bagwell et al.

(10) Patent No.: US 7,367,085 B2
(45) Date of Patent: May 6, 2008

(54) FLOOR TOOL

(75) Inventors: Martin Paul Bagwell, Andover (GB); Alastair Gordon Anderson, Munich (DE)

(73) Assignee: Dyson Limited, Wiltshire (GB)

( * ) Notice: Subject to any disclaimer, the term of this patent is extended or adjusted under 35 U.S.C. 154(b) by 533 days.

(21) Appl. No.: 10/494,294

(22) PCT Filed: Oct. 25, 2002

(86) PCT No.: PCT/GB02/04834

§ 371 (c)(1),
(2), (4) Date: Oct. 18, 2004

(87) PCT Pub. No.: WO03/039315

PCT Pub. Date: May 15, 2003

(65) Prior Publication Data

US 2005/0055798 A1 Mar. 17, 2005

(30) Foreign Application Priority Data

Nov. 3, 2001 (GB) ..... 0126494.4
Apr. 27, 2002 (GB) ..... 0209692.3

(51) Int. Cl.
*A47L 9/02* (2006.01)

(52) U.S. Cl. ..... 15/415.1; 15/421

(58) Field of Classification Search ..... 15/421
See application file for complete search history.

(56) References Cited

U.S. PATENT DOCUMENTS 958,803 A 3/1961 Erratum
4,564,972 A * 1/1986 Varin ..... 15/358

FOREIGN PATENT DOCUMENTS

| | | |
|---|---|---|
| DE | 42 43 244 | 6/1994 |
| EP | 0 235 614 | 9/1987 |
| EP | 0 313 403 | 4/1989 |
| EP | 0 353 546 | 9/1990 |
| EP | 0 668 044 A1 | 8/1995 |
| EP | 0 793 938 | 9/1997 |
| EP | 1 110 496 | 6/2001 |
| EP | 1 136 029 | 9/2001 |
| FR | 2 439 577 | 10/1979 |
| GB | 1138650 | 1/1969 |
| GB | 2 200 538 | 8/1988 |
| GB | 2 253 780 | 9/1992 |
| GB | 2 358 790 | 8/2001 |
| WO | 02/26097 | 4/2002 |

OTHER PUBLICATIONS

Japanese Office Action mailed Feb. 13, 2007 directed to counterpart foreign application.

* cited by examiner

*Primary Examiner*—David A Redding
(74) *Attorney, Agent, or Firm*—Morrison & Foerster LLP

(57) ABSTRACT

A floor tool for use in vacuum cleaning floor surfaces includes a sole plate for engaging with a floor surface, a supporting body for the sole plate having means such as wheels or rollers for allowing the body to ride along the floor surface and an outlet conduit for coupling to a wand of a vacuum cleaner. The outlet conduit is mounted to the support platform by a connecting arm, a first end of the connecting arm being pivotally connected to the outlet conduit about a first axis and the second end of the connecting arm being pivotally connected to the supporting body about a second axis. The first and second axes are substantially parallel to one another. Fluid flow from the sole plate can be carried by a flexible hose or by the connecting arm itself.

15 Claims, 14 Drawing Sheets

FLOOR TOOL

REFERENCE TO RELATED APPLICATIONS

This application is the national stage under 35 USC 271 of International Application No. PCT/GB02/04834, filed Oct. 25, 2002, which claims the priority of United Kingdom Application Nos. 0126494.4 and 020692.3, filed Nov. 3, 2001, and Apr. 27, 2002, respectively, the entire contents of which are incorporated herein by reference.

FIELD OF THE INVENTION

This invention relates to a floor tool for use with a vacuum cleaner.

BACKGROUND OF THE INVENTION

Cylinder or canister vacuum cleaners, as shown in FIG. 1, generally comprise a main body 10 which contains separating apparatus 11 such as a cyclonic separator or a bag for separating dirt and dust from an incoming dirty airflow. The dirty airflow is introduced to the main body 10 via a hose 15 and wand 16 assembly which is connected to the main body 10. The main body 10 of the cleaner is dragged along by the hose as a user moves around a room. A cleaning tool is attached to the remote end of the hose and wand assembly. A range of cleaning tools are usually supplied so that a user can choose an appropriate tool for their cleaning task, such as a crevice tool and a brush tool. For general on-the-floor cleaning the vacuum cleaner is provided with a floor tool 20.

FIG. 2 shows a known floor tool of the type manufactured and sold by Dyson Limited. The floor tool 20 comprises a lower face 150, commonly known as a sole plate, which engages with a floor surface. The sole plate 150 defines a suction channel 155 which faces the floor surface and serves, in use, to expose the floor surface to a suction force which is sufficient to carry dirt and debris from the surface. The tool 20 also comprises an outlet connector 101, 102 which fits to the wand 16 (FIG. 1) and a short connecting duct 120 for carrying airflow from the sole plate 150 to the outlet connector 101, 102. One end of the connecting duct 120 is pivotally mounted to the sole plate about axis 105 and the other end of the connecting duct is pivotally mounted to the outlet connector 101 about axis 115. The connecting duct 120 has a pair of floor engaging wheels 90 mounted on it. In use, this arrangement translates a user's pushing and pulling movement of the wand to a gliding movement of the sole plate 150 over the floor surface. However, it has been found that the manner in which some users operate the wand can cause the sole plate 150 of the tool 20 to lift off of the floor surface. This has a detrimental effect on the pick-up performance of the floor tool 20.

SUMMARY OF THE INVENTION

Thus, the present invention seeks to provide an improved floor tool.

Accordingly, the present invention provides a floor tool for use in vacuum cleaning floor surfaces comprising a sole plate for engaging with a floor surface, a supporting body for the sole plate having means for allowing the body to ride along the floor surface, an outlet conduit for coupling to a wand of a vacuum cleaner, and a connecting arm for connecting the outlet conduit to the supporting body, a first end of the connecting arm being pivotally connected to the outlet conduit about a first pivotal axis, the second end of the connecting arm being pivotally connected to the supporting body about a second pivotal axis, the first and second pivotal axes being substantially parallel to one another, and the connecting arm being pivotable between lowered and raised positions.

This has the advantage that the floor tool is less prone to lifting off of a floor surface as a user manipulates the tool. We have found that this improved contact with the floor surface can increase the pick-up performance of the tool.

Preferably the sole plate is pivotally mounted to the supporting body and, more preferably, the sole plate is pivotally mounted to the supporting body at a position which lies over a suction channel of the sole plate. The pivotal mounting of the sole plate causes the tool, in use, to rotate forwardly or backwardly. This can be used to bring a working edge of the sole plate into contact with the floor surface so as to agitate the floor surface. In these arrangements it is preferable that the sole plate is pivotally mounted to the supporting body and the connecting arm is pivotally mounted to the supporting body at a position which is substantially coincident with the pivotal axis of the sole plate.

The connecting arm can comprise a rigid member which provides mechanical connection between the outlet conduit and the supporting body and the floor tool can further comprise a flexible hose for carrying fluid flow between a suction outlet of the sole plate and the outlet conduit. Alternatively, the connecting arm itself can carry fluid flow between a suction outlet of the sole plate and the outlet conduit.

Preferably the floor tool further comprises a skirt for riding along the floor surface during hard floor cleaning, and wherein the sole plate is movable between a working position, in which the sole plate is lower than the skirt and a stored position in which the sole plate is higher than the skirt.

Preferably the supporting body of the floor tool has a channel for receiving the connecting arm. The connecting arm can be dimensioned such that, when the connecting arm lies alongside the supporting body, the pivotal connection between the first end of the connecting arm and the outlet conduit lies within the channel on the supporting body. For compactness, wheels or rollers can be mounted on each side of the channel.

Preferably the floor tool further comprises stop means for limiting movement of the connecting arm in a direction away from the chassis. Where the supporting body of the floor tool has a channel for receiving the connecting arm, the stop means can act between the connecting arm and at least one side of the channel.

The floor tool can be used with cylinder, upright and other types of vacuum cleaning appliances.

BRIEF DESCRIPTION OF THE DRAWINGS

Embodiments of the present invention will now be described with reference to the accompanying drawings, in which.

DETAILED DESCRIPTION OF THE INVENTION

Figure 3:
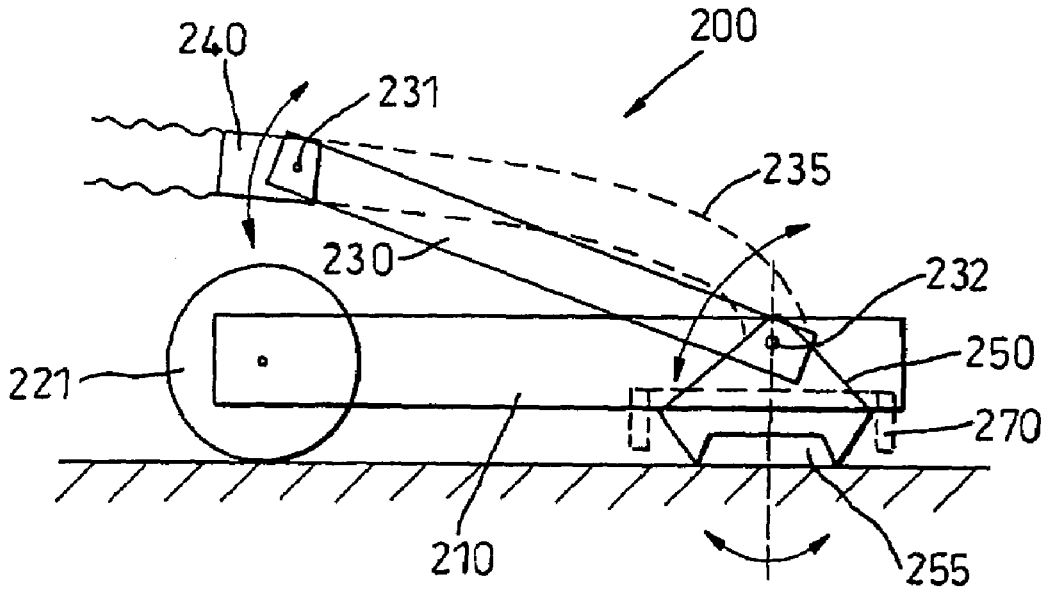
FIG. 3 shows, in schematic form, a floor tool in accordance with an embodiment of the invention.

FIG. 3 shows, in simplified form, the components of a floor tool in accordance with a first embodiment of the invention. The main components of the tool 200 are a main chassis 210, a sole plate 250, a wand connector 240 for connecting to a wand or hose of a vacuum cleaner, a connecting arm 230 which connects the chassis 210 to the wand connector 240 and a hose 235 for carrying airflow from the sole plate 250 to the wand connector 240. The sole plate defines an air inlet 255 which, in use, faces the floor surface and extends transversely across the full width of the tool. The chassis 210 is provided with wheels 221 to allow it to move across a floor surface. The wand connector 240 is dimensioned so as to mate with a wand (i.e. a pipe or a set of telescopic pipes) of a vacuum cleaner. The wand connector 240 is connected to the chassis 210 by a connecting arm 230. A first end of the connecting arm 230 is pivotally connected to the wand connector 240 by a joint 231. The other end of the connecting arm 230 is pivotally connected, by joint 232, to the chassis 210. Connecting arm 230 provides a mechanical connection between the wand connector 240 and chassis 210 and thus it serves to transmit the force exerted by a user on the wand to the chassis 210. The connecting arm 230 can be formed as an airflow conduit for carrying airflow from the sole plate 250 to the wand connector 240. In this case, joints 231, 232 are articulated, airtight, joints which maintain an airtight seal between the connecting arm conduit 230 and the outlet of the sole plate 250 and the inlet of the wand connector 240 as these parts move with respect to one another. Alternatively, as is shown in FIG. 3, the airflow between the sole plate 250 and wand connector 240 can be carried by a flexible conduit 235 which is separate from the connecting arm 230. The use of a flexible conduit to carry the airflow allows a more reliable seal to be formed between the wand connector 240 and the connecting arm 230 which will remain airtight over a range of relative positions of the two parts. Thus, this solution can be cheaper and more reliable.

The provision of a pivotable joint 231, 232 at each end of the connecting arm 230 allows the wand connector 240, and the wand or hose fitted to the wand connector 240, to be moved through a wide range of operating positions with respect to the chassis 210. Furthermore, the chassis 210 and hence the sole plate 250 remain in a stable position throughout the range of operating positions.

It is preferable that sole plate 250 is pivotally connected to the chassis 210 and that the axis about which the sole plate 250 pivots is coincident with the axis 232 about which the connecting arm 230 pivots about the chassis 210. Also, it is preferable for the sole plate to be pivotally connected at a position which lies directly above the centre of the suction channel 255. The connection between the sole plate 250 and the chassis 110 allows a limited degree of movement between these parts. This is achieved by mounting stops on the chassis 210 at each permitted extent of the path of the sole plate.

It is common for a floor tool to be operable in both a carpet cleaning mode, where the sole plate rides along the floor surface, and a hard floor cleaning mode where a flexible skirt of some kind is brought into contact with the floor surface and the sole plate is spaced from the hard floor surface. The tool shown in FIG. 3 can be provided with a skirt 270 (shown in broken lines) which surrounds the sole plate 250 and which is movable from the raised position shown in FIG. 3 to a lowered position where it lies beneath the sole plate 250.

Figure 4:
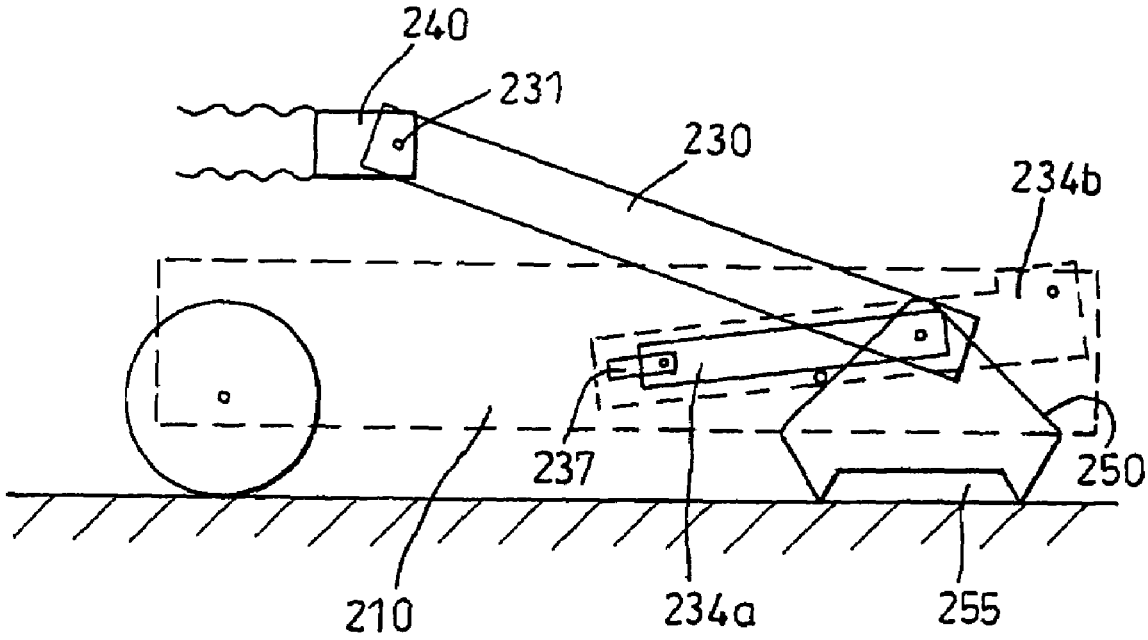
FIG. 4 shows, in schematic form, an alternative embodiment of the invention.
Figure 5:
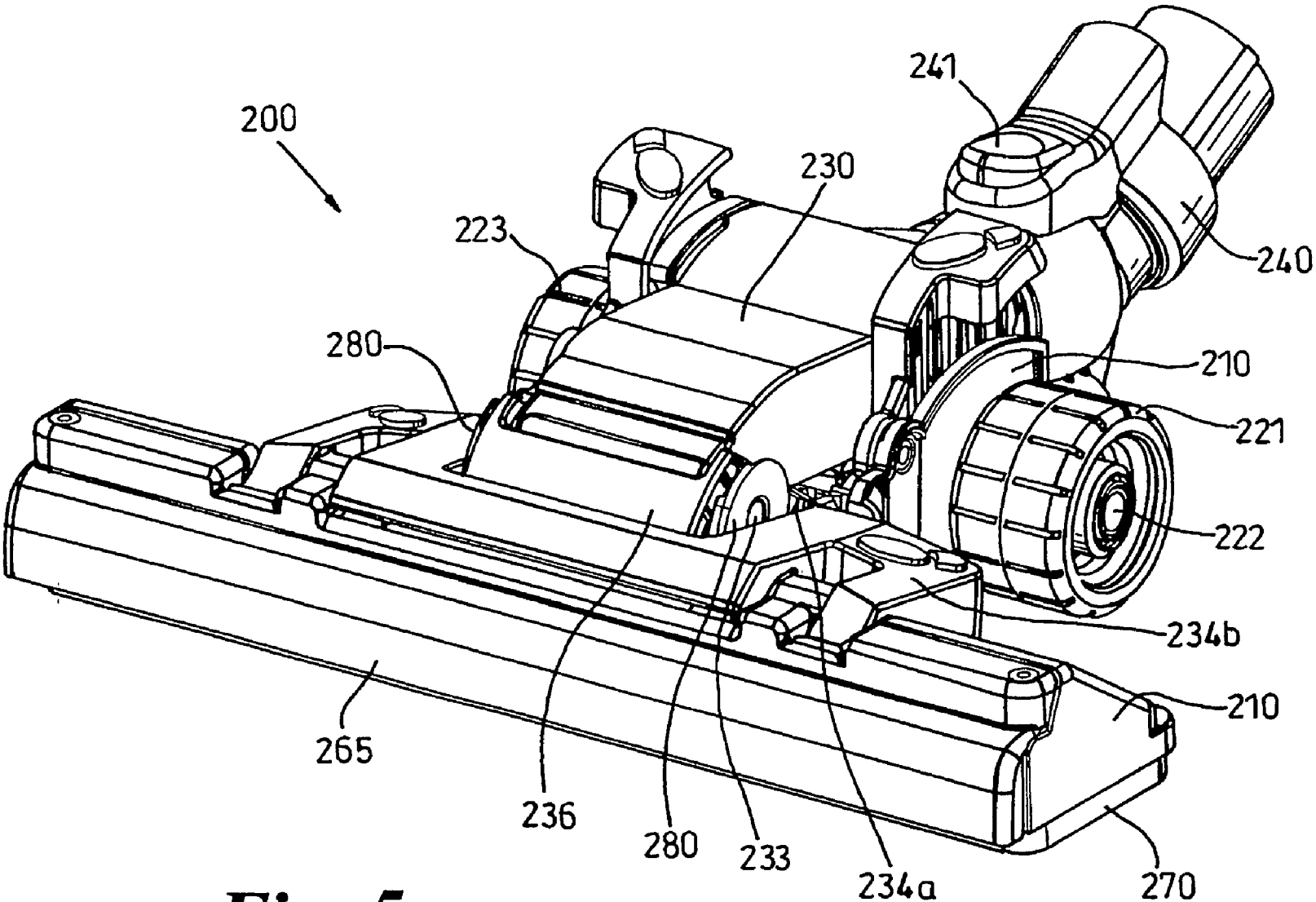
FIG. 5 shows the embodiment of FIG. 4 in more detail.

An alternative to moving the skirt 270 is for the skirt 270 to remain fixed and to raise or lower the sole plate 250 itself. The tool which is shown in detail in FIGS. 5-10 has a movable sole plate 250 of this kind. Before describing this tool in detail, FIG. 4 shows the main components of the tool. Many of the components are the same as for the tool just described with reference to FIG. 3. The differences are in the mechanism which links the connecting arm 230 to the chassis 210. In FIG. 3 the connecting arm 230 pivots directly about the chassis 210 whereas in FIG. 4 connecting arm 230 is linked to the chassis 210 via two intermediate arms 234*a*, 234*b*. In carpet floor mode the sole plate 250 engages with the floor surface. Sole plate 250 is free to pivot directly about the connecting arm 230. In hard cleaning mode the sole plate is raised and rotated into a cavity within the chassis 210. It will be appreciated that the two intermediate arms 234*a*, 234*b* simply link the connecting arm 230 to the chassis 210 in a manner that allows the sole plate 250 to be lowered or raised. In the configuration shown in FIG. 4 the two intermediate arms 234*a*, 234*b* are locked in position and do not move. Similarly, in the configuration where the sole plate is raised, the intermediate arms are locked in a different position. In both configurations the connecting arm 230 effectively pivots about the chassis 210.

Figure 6:
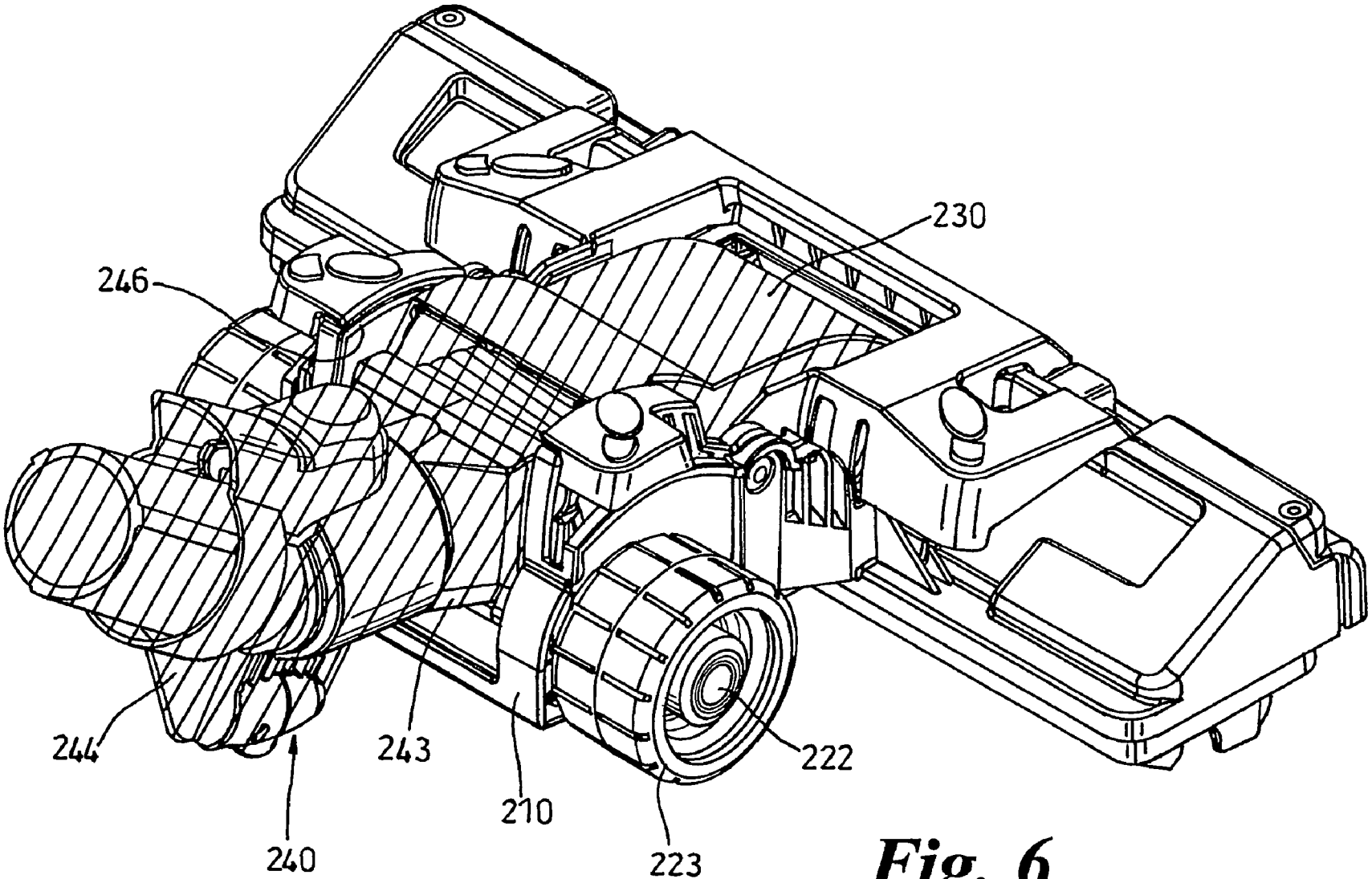
FIG. 6 shows the tool of FIG. 5 from the rear.

Referring now to FIGS. 5-10, these show a preferred embodiment of the floor tool in detail. As before, the main components of the tool 200 are a main chassis 210, a sole plate 250, a wand connector 240 for connecting to a wand or hose of a vacuum cleaner and a connecting arm 230 and a hose 235 for connecting the wand connector 240 to the chassis 210. When viewed from the rear, parallel to the floor, the chassis 210 has a generally unshaped channel which is sufficiently wide to receive the connecting arm 230. This permits the connecting arm 230, in use, to lie within the channel, as best shown in FIG. 6. The connecting arm may adopt this lowered position during a forward stroke or when a user is maneuvering the tool beneath an obstacle and wants to minimise the height of the tool. FIG. 6 shows the floor tool from the rear, with the movable parts, i.e. the connecting arm 230 and wand connector 240, shown with diagonal shading. The connecting arm 230 is shorter than the chassis so that it does not protrude beyond the back of the chassis when the connecting arm is brought to its lowest position.

Figure 9:
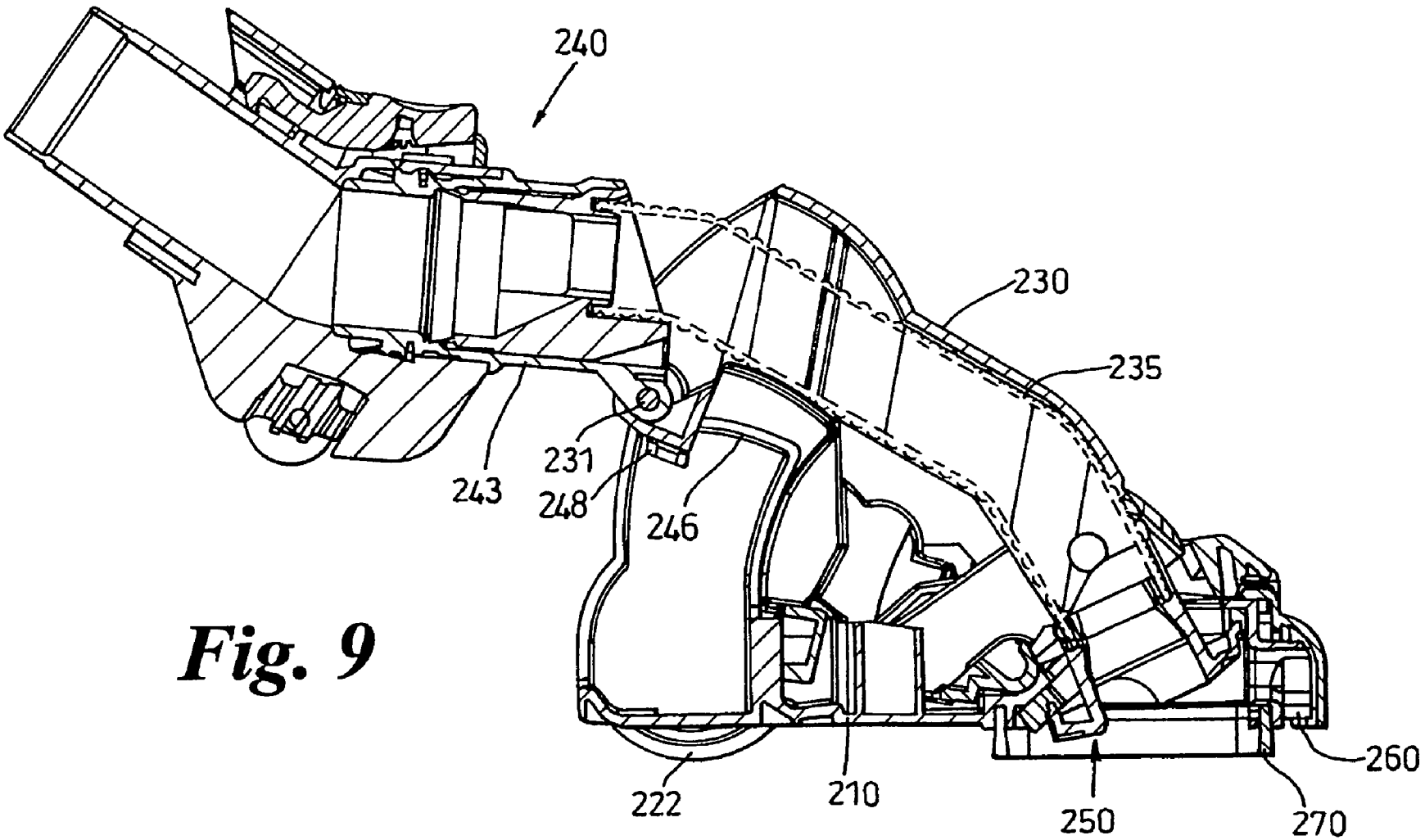
FIGS. 9 and 10 are further cross sections through the floor tool of FIGS. 5-8 with the tool in alternative configurations.
Figure 10:
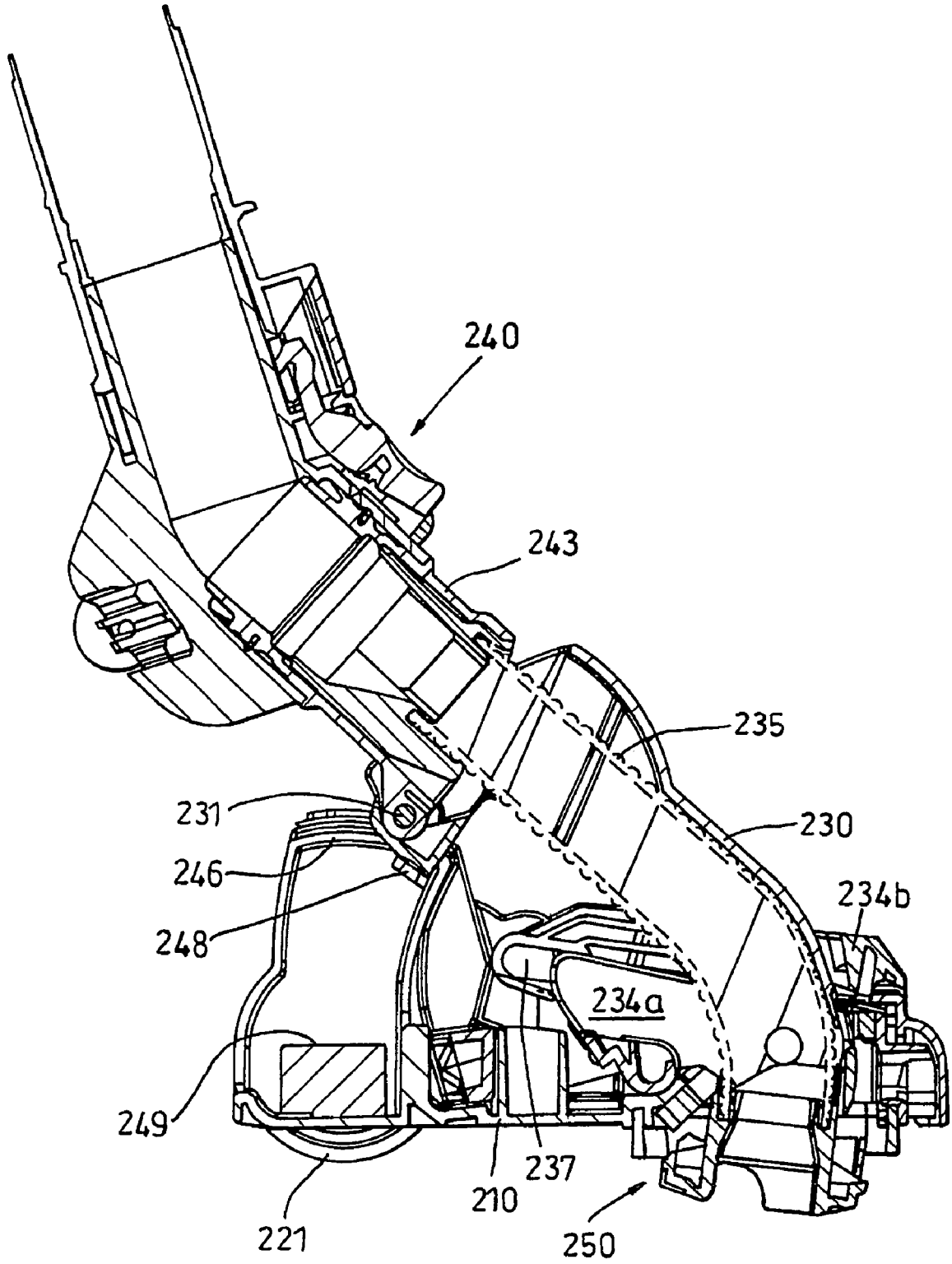

The chassis 210 is provided with wheels 221 which allow the chassis 210 to move across the surface of a floor. A short axle 222 is secured to, and extends outwardly from each side of, a side wall on the rearward part of the chassis 210. A wheel 221, 223 is rotatably secured on each of the axles 222 so as to allow movement of the tool across a floor surface. It will be appreciated that the two short axles 222 could be replaced by a single axle which extends across the full width of the chassis, the wheels could be replaced by rollers, by skids on the lower surface of the tool, or by some other means for allowing the floor tool to move across the surface of a floor. The chassis is provided with means for limiting the vertical movement of the connecting arm 230 beyond a predetermined point. In this embodiment, each side wall at the rear of the chassis 210 is capped by a flange 246 which extends inwardly into the channel and each side of the connecting arm 230 has an outwardly projecting peg 248. The connecting arm 230 is free to move within a predetermined vertical range. At the uppermost extent of the vertical range the peg 248 on the connecting arm 230 hits, and is arrested by, the flange 246 as is best shown in FIGS. 9 and 10. It will be appreciated that this function of limiting the vertical movement of the connecting arm 230 could be achieved in other ways. For example, the side walls can have an inwardly projecting peg which locates within a slot on the connecting arm 230. FIG. 10 shows how cushioning material 249, such as foam padding, can be provided on the base of the chassis at the position beneath where the connecting arm will lie so as to minimise damage and noise when the connecting arm 230 is lowered against the chassis 210.

Figure 1:
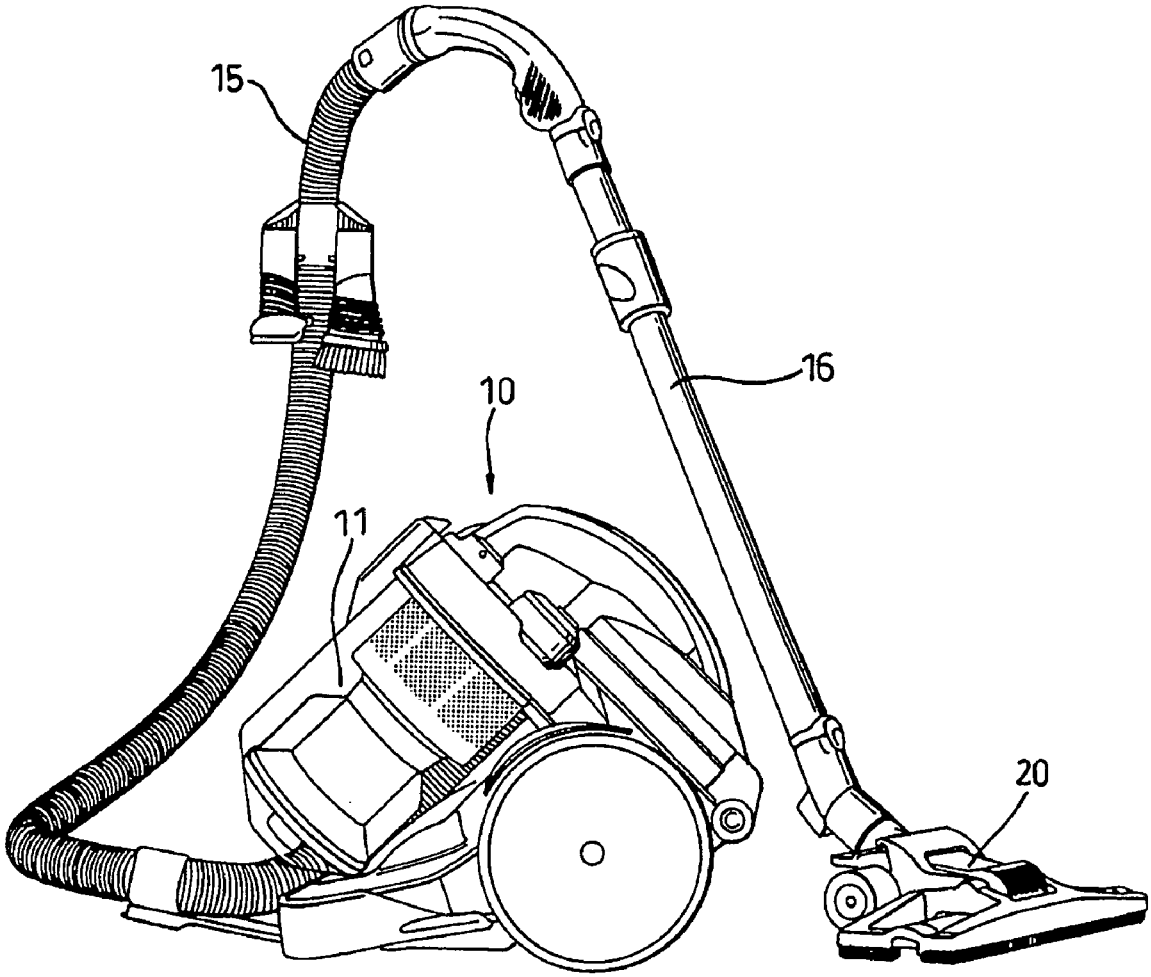
FIG. 1 shows a known vacuum cleaner and floor tool in accordance with the prior art.
Figure 2:
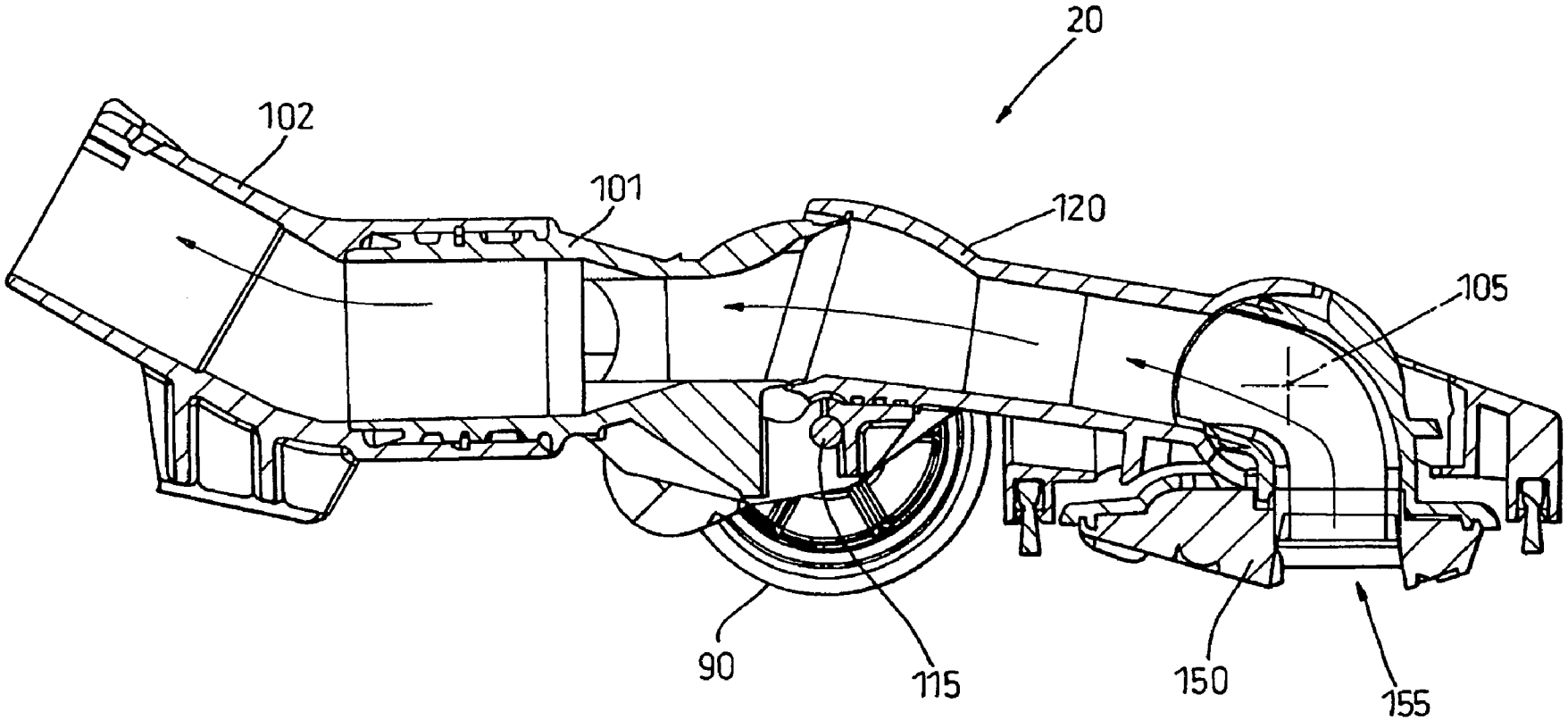
FIG. 2 shows the floor tool of FIG. 1 in more detail.

A wand connector 240 is located at the rear of the tool. The wand connector 240 is dimensioned so as to mate with a wand (16, FIG. 1) of a vacuum cleaner. The wand connector 240 is formed as two pipes 243, 244 which are jointed in a manner which permits rotational movement about the longitudinal axis of the pipes. The wand connector 240 has a castor wheel 245 mounted on its underside so as to minimise damage to a floor surface when the wand connector is moved into a fully lowered position. A release mechanism for the wand comprises a manually operable button 241 which is connected to a catch 242. Other connecting schemes could be used, such as a simple interference fit between the respective sleeves of the wand connector 240 and the wand. The wand connector 240 is connected to the chassis 210 by a connecting assembly 230, 234. The connecting assembly comprises a connecting arm 230 and intermediate arms 234*a*, 234*b*. A first end of the connecting arm 230 is pivotally connected to the wand connector 240 by a joint 231. The other end of the connecting arm 230 is pivotally connected, by joint 232, to a first intermediate arm 234*a*. The other end of the intermediate arm 234*a* carries a peg which is constrained to slide within a slot formed on the inner wall of a first end of the second intermediate arm 234*b*. Intermediate arm 234*a* is also pivotally connected to the chassis 210. The other end of intermediate arm 234*b* is pivotally connected to the upper face of the chassis 210. A flexible hose, shown as broken line 235, connects the wand connector 240 directly to the sole plate 250. A first end of the hose 235 is sealed in an airtight manner against the suction outlet of the sole plate and the second end is sealed in an airtight manner against the wand connector 240. The provision of a pivotable joint 231, 232 at each end of the connecting arm 230 allows the wand connector 240, and the wand or hose fitted to the wand connector 240, to be moved through a wide range of positions with respect to the chassis 210. Furthermore, the chassis 210 remains in a stable position throughout the range of positions. Conveying the airflow between the sole plate 250 and wand connector 240 by a flexible hose 235 which is separate from the connecting arm 230 permits an even greater degree of freedom of movement of the wand connected to the tool. The arrangement of intermediate arms 234*a*, 234*b* between the connecting arm 230 and chassis 210 is required in order to allow the sole plate 250 to move between a working position and a retracted position, as will be described later. In a simpler tool, such as the one shown previously in FIG. 2, the sole plate 250, chassis 210 and connecting arm 230 can all share the same pivot shaft, such that the sole plate pivots about the chassis 210 and the connecting arm 230 can pivot freely about the sole plate 250 and chassis 210.

Figure 7:
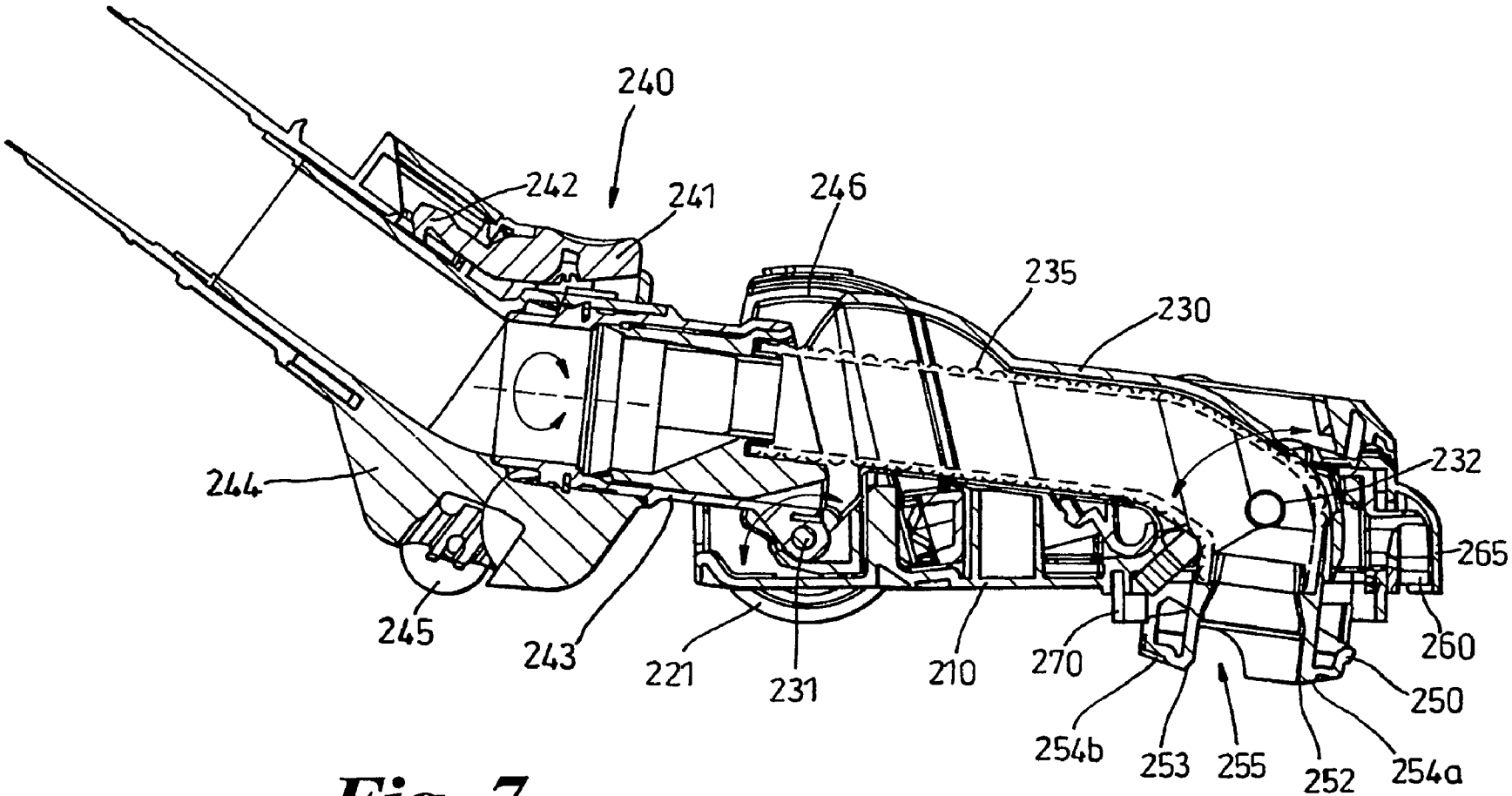
FIG. 7 is a cross section through the floor tool shown in FIGS. 5 and 6 with the sole plate in a lowered position.

The maneuverability of the tool is best illustrated by FIGS. 7, 9 and 10. In FIG. 7 the connecting arm 230 and wand connector 240 are lying close to the floor, with the connecting arm 230 lying within the u-shaped channel of the chassis 210. The tool will adopt this configuration as a user pushes the tool forwardly or when a user wishes to manoeuvre the tool beneath a low-lying object. In contrast, FIGS. 9 and 10 show the connecting arm 230 and wand connector 240 in a raised position. The floor tool will usually adopt this position when a user drags the tool rearwardly. The connecting arm 230 has reached its highest position, with peg 248 pressing against flange 246. In FIG. 10 the wand connector has swiveled about pivot point 231 into an almost upright position. In each of these configurations, the floor tool will remain in contact with the surface.

A sole plate 250 is pivotally mounted to the connecting arm 230 and first intermediate arm 234*a* of the connecting assembly towards the front of the chassis. Two flanges 280 extend upwardly from the upper face of the sole plate 250. An aperture in each flange 280 is rotatably held by a peg 233 on each side of the intermediate arm 234*a*. The sole plate 250 is free to rotate, within a limited angular range, about the arm 234*a*. The axis of the joint between the connecting arm 230 and intermediate arm 234 is coincident with the axis of the joint between the intermediate arm 234 and the sole plate 250 such that force applied by a user to the wand connector and hence the connecting arm 230, is transmitted directly to the sole plate 250.

The sole plate 250 of the tool will now be described in more detail. The floor tool 200 can be used in a carpet cleaning mode, where the sole plate 250 engages with, and rides along, the floor, or in a 'hard floor' mode where a flexible skirt 270 rides along the floor surface and the sole plate is spaced from the floor.

Figure 8:
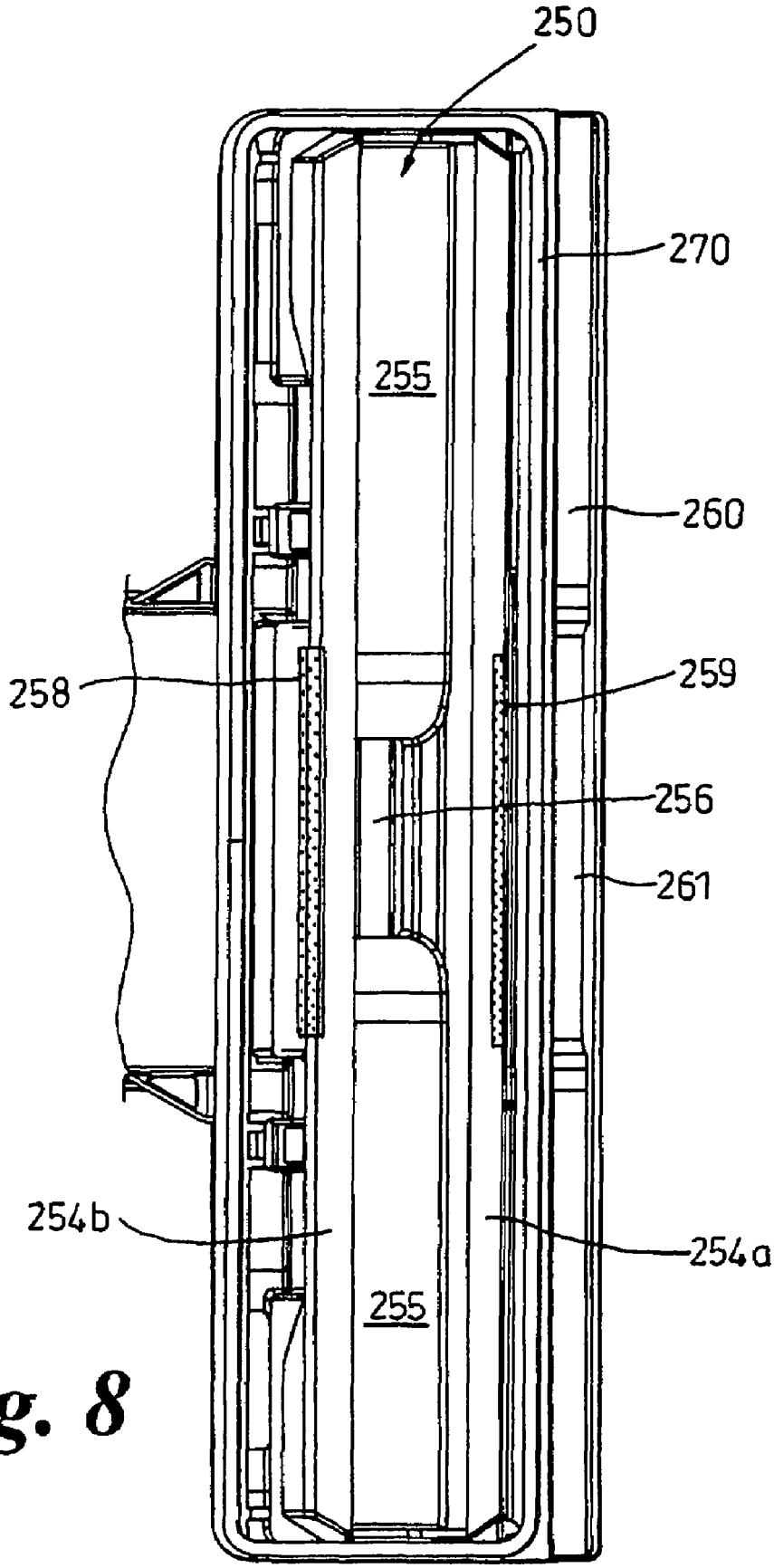
FIG. 8 shows the lower face of the floor tool of FIGS. 5-7.

FIGS. 7 and 10 show the sole plate 250 deployed in a carpet cleaning mode. The sole plate 250 is shown in profile in FIG. 7 and the lower, plan view of the sole plate is shown in FIG. 8. The sole plate 250 has a centrally mounted air inlet 256. Two suction channels 255 extend transversely across the tool from each side of the inlet 256. Each channel 255 terminates in a bleed air inlet on the side of the sole plate. The lower face of the sole plate has two spaced apart sharply defined edges 252, 253 which will be called working edges. The forward working edge 252 is defined by the intersection between the inner wall of the suction channel and a planar surface 254*a* on the lower face of the sole plate. Similarly, the rear working edge 253 is defined by the intersection between the inner wall of the suction channel and a planar surface 254*b* on the lower face of the sole plate. The working edges 252, 253 are sharply defined, as shown in FIG. 7, so as to provide an effective agitating action when the floor tool is used on carpeted surfaces. This agitating effect is further enhanced by the pivotal connection between the sole plate 250 and connection member 230. A small radius of curvature has been found to be provide an effective agitating action on floor surfaces. The working edges 252, 253 extend across the full width of the floor tool. Lint pickers 258, 259 are positioned on the planar surfaces 254*a*, 254*b* and are spaced from the working edges 252, 253 so that the working edges can perform an agitating action on carpeted surfaces across their full width. Each of the lint pickers 258, 259 is of a conventional type, comprising a strip of material in which a plurality of tufts of fine fibre are secured. Each lint picker 258, 259 is secured on an arcuately-shaped support that extends outwardly from the planar surface 254*a*, 254*b* on which it is located. The spacing of the lint pickers 258, 259 from the adjacent working edge 252, 253 can be varied from the spacing as shown in the drawings. The use of lint pickers causes an increase in the force that a user requires to push or pull the floor tool across a floor surface. It would be possible to increase the width of the lint pickers 258, 259 to the full width of the floor tool although this would incur an increase in the push force required by a user.

Figure 11:
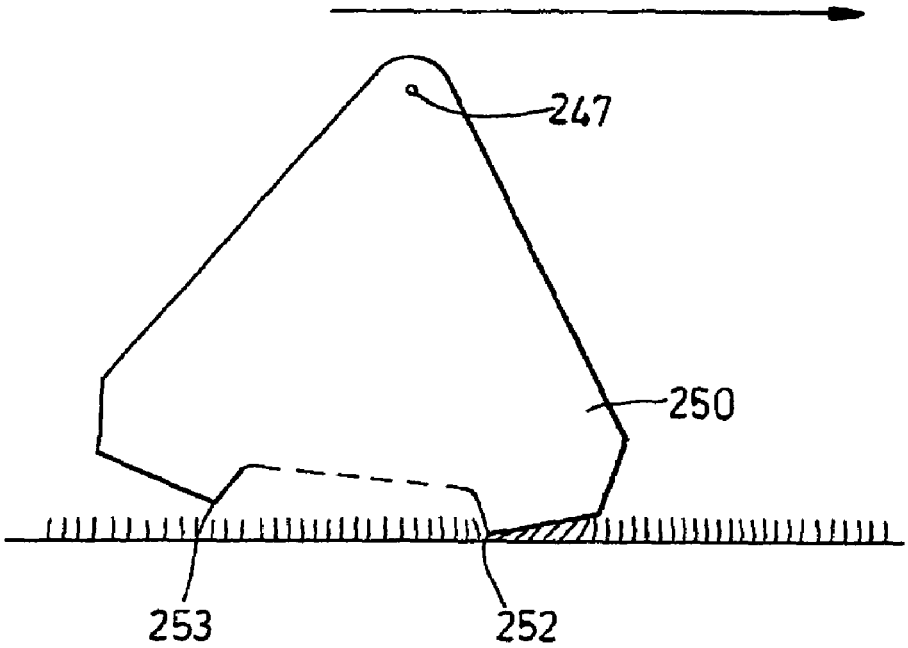
FIGS. 11 and 12 show, in schematic form, the action of the sole plate.
Figure 12:
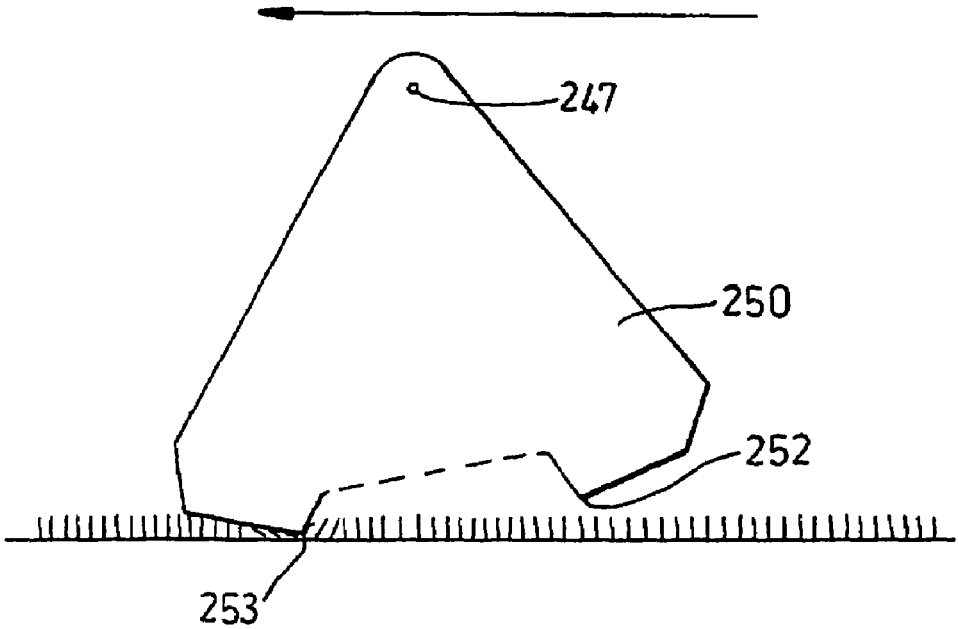

FIGS. 11 and 12 show how the sole plate 250 of the floor tool 200 operates in use. Firstly, FIG. 11 shows the sole plate 250 as it is pushed forwardly across a floor surface. As the tool is pushed forwardly, the sole plate 250 rotates about pivot 247, bringing the forward working edge 252 into closer contact with the floor surface than the rear working edge 253. The sharp edge 252 has an effective agitating effect on the surface, parting the pile of the surface and releasing dirt in a flicking action. As dirt is released, it is swept along the suction channel 254, 255 by the airflow in the suction channel towards suction inlet 256. Also, forward lint picker 258 is brought into contact with the floor surface. In its lowered position, the forward lint picker 258 allows lint to pass. The rear lint picker 259 remains close enough to the surface to serve a useful blocking action on lint.

FIG. 12 shows the floor tool 200 as it is pushed rearwardly across a floor surface. As the tool is pushed rearwardly, the sole plate 250 rotates about pivot 247 bringing the rear working edge 253 into closer contact with the floor surface than the forward working edge 252. The sharp edge 253 has the same effect as forward edge 252 did during the forward action, i.e. it agitates the surface, parting the pile of the surface and releasing dirt in a flicking action. Dirt is swept along the suction channel 254, 255 by the airflow in the suction channel towards suction inlet 256. Rear lint picker 259 is brought into contact with the floor surface and allows lint to pass. The forward lint picker 258, while raised higher than it would be during the forward action, remains close enough to the surface to block the passage of lint. It can be seen that once the floor tool has passed over lint, the lint becomes trapped between the lint pickers and is prised from the surface.

Figure 13:
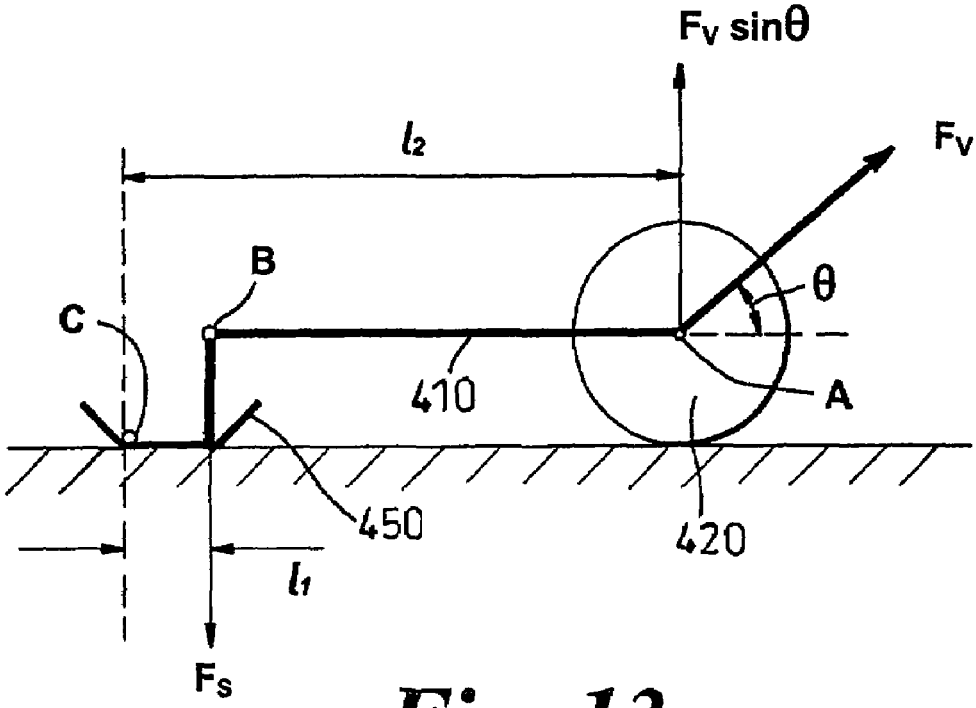
FIG. 13 shows the forces on a conventional floor tool.
Figure 14:
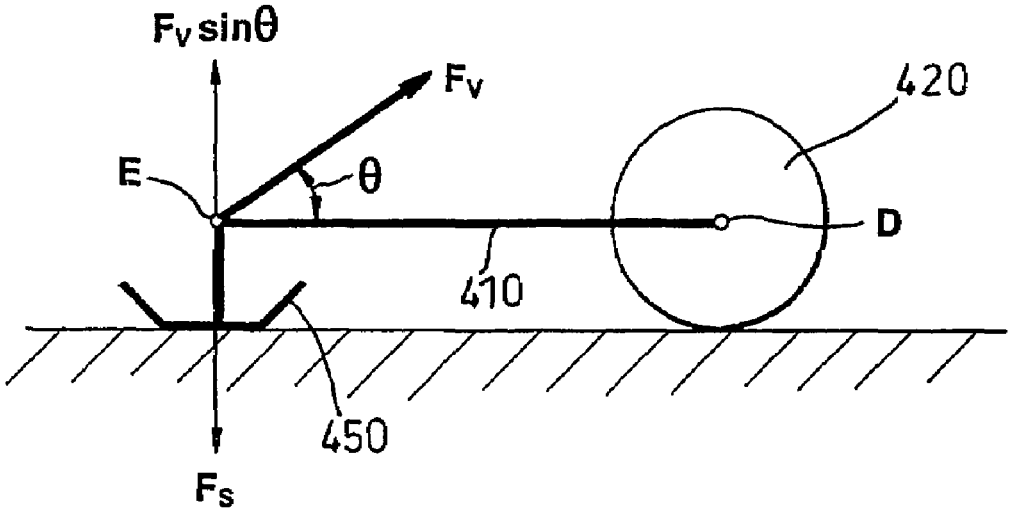
FIG. 14 shows the forces on a floor tool in which the push/pull force is applied close to the sole plate.

The effect of driving the floor tool from a position close to the sole plate is illustrated by FIGS. 13 and 14. FIG. 13 shows a conventional floor tool, with a chassis 410, wheels 420 and sole plate 450. A user applies a push/pull force $F_V$ to the tool at point A. $F_S$ represents the suction force exerted on the floor surface by the air being drawn into the sole plate. During a backwards stroke, the forces (moment) about point C are:

$$M_C = l_1 \cdot F_S - l_2 \cdot F_V \sin\theta$$

Thus, for the sole plate to remain on the floor surface:

$$l_1 \cdot F_S \geqq l_2 \cdot F_V \sin\theta$$

Point C represents the point about which the floor tool will be levered from the floor surface when a force is applied in the vertical direction during a backwards stroke.

In contrast, FIG. 14 shows a floor tool in accordance with an embodiment of the invention with a chassis 410, wheels 420 and sole plate 450 and where a user applies a push/pull force $F_V$ to the tool at point E. As before, $F_S$ represents the suction force exerted on the floor surface by the air being drawn into the sole plate. During a backwards stroke, for the sole plate to remain on the floor surface:

$$F_S \geqq F_V \sin\theta$$

This is a significantly simpler requirement than that in FIG. 13. By bringing the outlet connector above the sole plate, the levering effect of the outlet connector is greatly reduced. FIG. 14 shows the ideal arrangement where the point at which the push/pull force is applied to the chassis, point B, is directly above the sole plate. As the point at which the push/pull force is applied to the chassis moves away from the sole plate, i.e. rightwards in FIG. 14, there is an increased risk that the floor tool will be 'pealed' away from the floor surface during a backwards stroke since there is now a levering action on the tool. Although it is preferred that the sole plate is pivotally mounted to the chassis, the sole plate can be fixed with respect to the chassis 410 and still benefit from a reduced risk of 'pealing' with the push/pull force being applied in the manner shown here.

Figure 15:
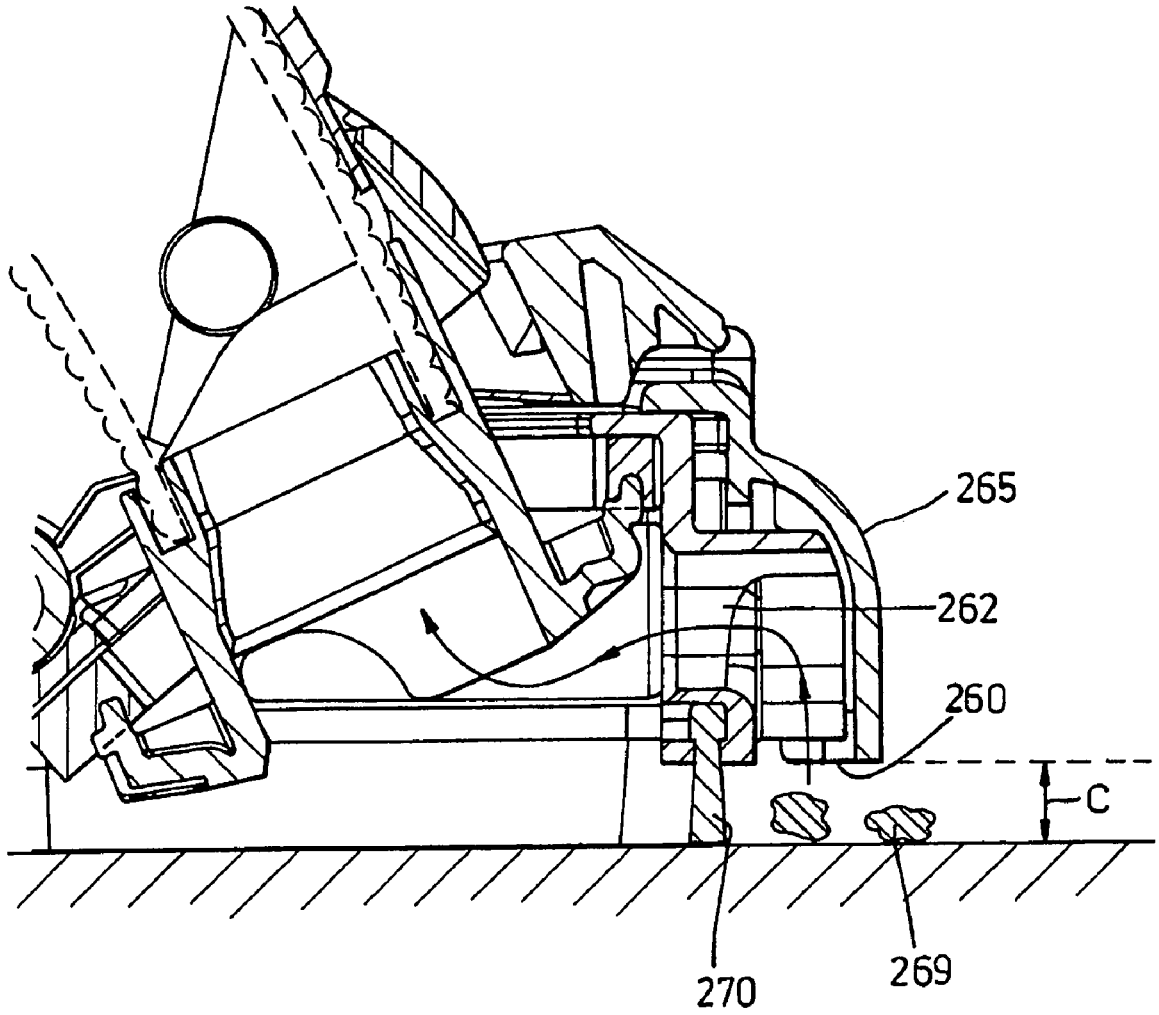
FIG. 15 shows in detail, the passage of debris into the floor tool during a hard floor mode of cleaning operation.

As described previously, in a hard floor cleaning mode the sole plate 250 is spaced away from the floor surface. In the embodiment shown in FIGS. 8, 9 and 15 this is achieved by retracting the sole plate 250 within the chassis such that only skirt 270 rests against the floor surface. The skirt is formed as a dense curtain of fibres, such as Nylon fibres, which are secured, such as by crimping, to the sole plate 250. The sole plate 250 is retractable into the position shown in FIG. 9, with the lower surface of the sole plate being inclined with respect to the plane of the suction opening. Skirt 270 forms a continuous curtain around the suction opening and serves to maintain a region of low pressure adjacent the floor surface. A bumper 265 on the forward edge of the chassis 210 defines a suction channel 260 which is directed downwardly towards the floor surface and extends across the full width of the tool. The bumper 265 is sufficiently spaced above the lowermost extent of the skirt (see C, FIG. 15) such that large debris 269 can pass beneath the bumper where it will lie beneath suction channel 260. Suction channel 260 communicates with the suction chamber within the chassis 210 via a conduit 262 into the main suction space within the chassis 210. The sole plate 250 is inclined in a direction such that airflow from channel 260 can easily flow around the lower surface of the sole plate 250 and then along the suction channels 254, 255 towards the suction inlet 256. Thus, airflow from channel 260 combines with airflow that is drawn beneath the skirt 270. FIG. 15 shows the path taken by air and debris when the floor tool is used in hard floor cleaning mode.

Figure 16:
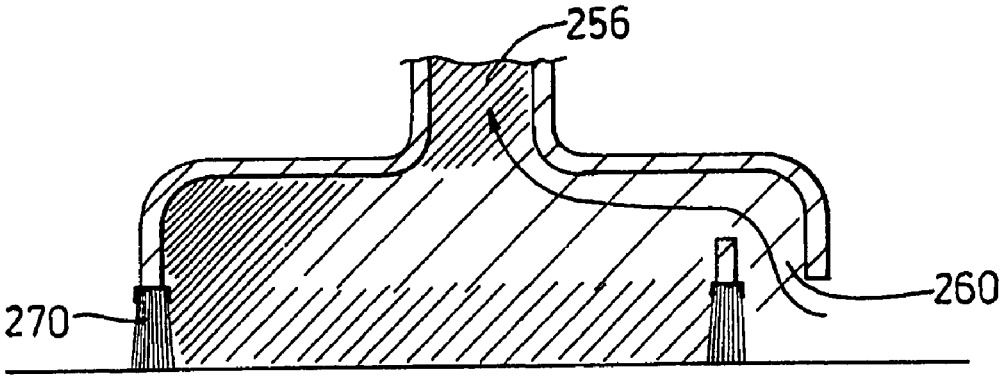
FIG. 16 shows a map of the pressures within a floor tool of the type shown in FIG. 15.
Figure 17A:
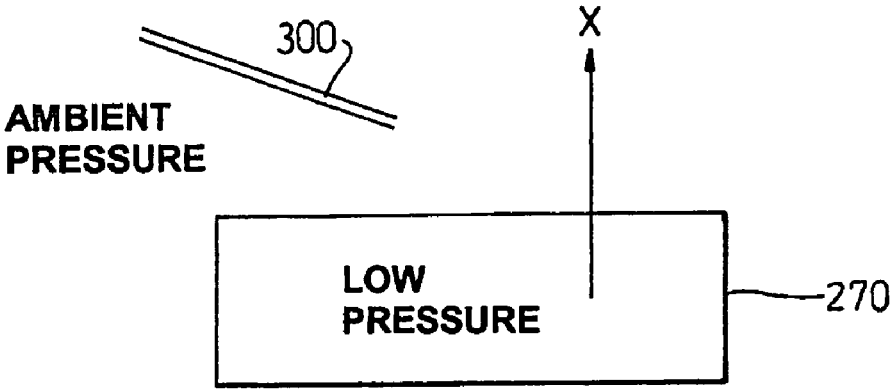
FIGS. 17A and 17B show the effect of using the floor tool on a floor surface having a crevice.
Figure 17B:
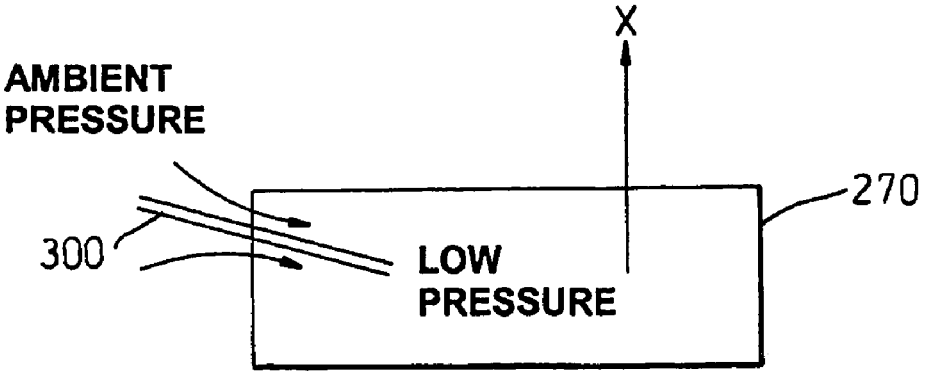

FIG. 16 is a cross section through the floor tool, showing an approximate map of pressures existing within the tool, the denser shading indicating the lower pressure regions. FIGS. 17A and 17B show the effect of using the floor tool on a surface. These figures show a plan view of the floor tool, moving in direction X across a floor surface. A region of low pressure is maintained within the skirted region of the tool, adjacent the floor surface. Thus, any dust lying within this region will be carried towards the suction inlet 256. A steady flow of air enters the tool via the suction inlet 260. This flow of air helps to maintain good separation efficiency within the separation system (11, FIG. 1) of the vacuum cleaner and is particularly important with a cyclonic separation system, such as one that uses a bank of parallel cyclonic separators. The flow of air through channel 260, and the spacing of the channel 260 from the floor surface helps to pick up any large debris from the floor surface. This debris would otherwise be pushed along the floor by the skirt 270. The continuous skirt 270 maintains a region of low pressure within the tool. This also helps to provide good pick-up from crevices 300 on the floor surface. As shown in FIG. 17B, as the tool moves across a crevice, the region of low pressure within the tool is connected to a region of ambient pressure outside the tool via the crevice 300. Thus, air flows from outside the tool, through the crevice 300, to the region of low pressure inside the tool, carrying any dust and debris from the crevice 300 along with the airflow.

Figure 18:
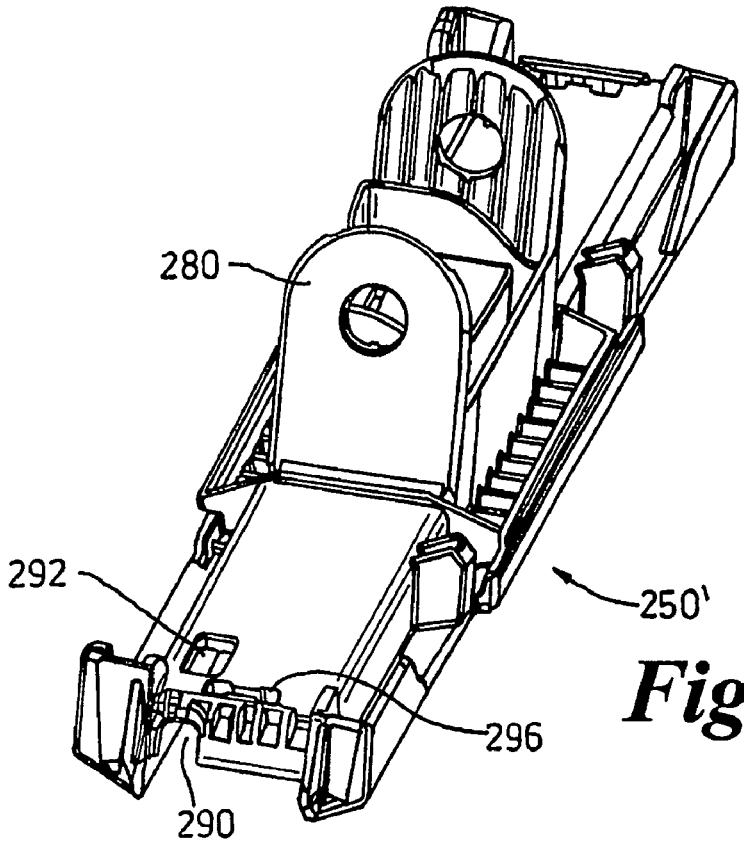
FIGS. 18-20 show a modification to the floor tool which allows a user to control the flow of air into the floor tool.
Figure 19:
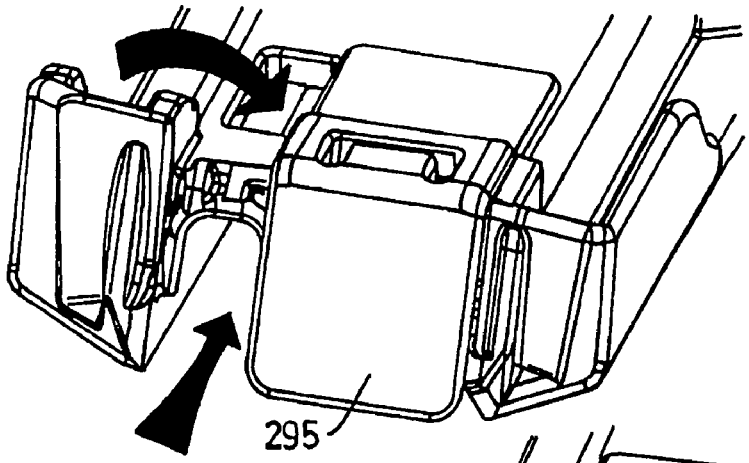
Figure 20:
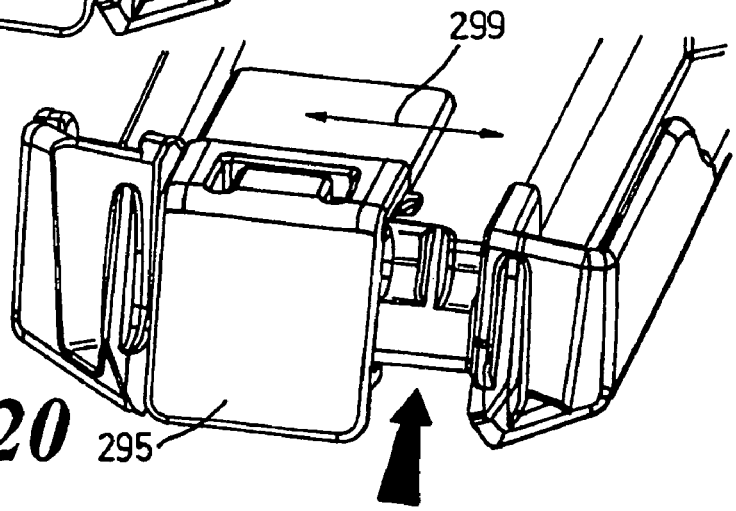

FIGS. 18-20 show a further modification to the floor tool in which the amount of air which bleeds into the tool can be manually controlled. FIG. 18 shows a modified form 250' of the sole plate 250 of the floor tool which has previously been described. As before, each side of the main suction channel 255 of the tool has an inlet aperture 290 through which, in use, air can bleed into the suction channel 255 during carpet cleaning mode. In this modified sole plate a valve 295 is fitted on the side of the sole plate. The valve is movable between an open position, as shown in FIG. 19, in which a maximum amount of air can bleed into the suction channel 255, and a closed position, as shown in FIG. 20, in which a lesser amount of air can bleed into the suction channel 255. The valve can be manually slid in direction 299 between the two positions. A pair of depressions 296 on the upper face of the sole plate cooperate with a small projection on the underside of the valve (not shown) to allow the valve to be positively held in each of the two positions. The sole plate 250' is further modified from sole plate 250 in that an additional bleed air inlet 292 is located on the upper face of the sole plate. A similar inlet 292 is positioned on each side of the sole plate. As can be seen in FIGS. 19 and 20, the valve seals the inlet 292 in the closed position.

In use, a user can set the valves 295 on each side of the sole plate to the same position (e.g. both valves open) or to different positions (i.e. one valve open, one valve closed), so as to select the amount of bled air and hence push resistance that they feel happy with. The amount of push resistance will vary between floor coverings and different users will prefer different amounts of push resistance.

In a further modification the valves 295 can be arranged such that they offer a wider range of settings. This can be achieved with an inlet 290 which varies in height in the direction 299 and a valve which can be positioned in a greater number of positions (e.g. three different positions.) The valves can be applied to a floor tool, as shown here, or to the cleaning head of an upright vacuum cleaner. In the closed position, the valve can be arranged to admit a small amount of bled air (as shown in FIG. 20) or no bled air at all.

The invention claimed is:

1. A floor tool for use in vacuum cleaning floor surfaces, comprising:

a sole plate for engaging with a floor surface, a supporting body for the sole plate having means comprising a wheel or roller on the supporting body for allowing the body to ride along the floor surface, an outlet conduit for coupling to a wand of a vacuum cleaner, and a connecting arm for connecting the outlet conduit to the supporting body, a first end of the connecting arm being pivotally connected to the outlet conduit about a first pivotal axis, the second end of the connecting arm being pivotally connected to the supporting body about a second pivotal axis, the first and second pivotal axes being substantially parallel to one another, and the connecting arm being pivotable between lowered and raised positions, wherein a portion of the connecting arm is located between the second axis and the means for allowing the body to ride along the floor surface.

2. A floor tool according to claim 1, wherein the connecting arm is pivotally connected to the supporting body about an axis which is substantially over the sole plate.

3. A floor tool according to claim 1 or 2, wherein the sole plate is pivotally mounted to the supporting body.

4. A floor tool according to claim 3, wherein the sole plate is pivotally mounted to the supporting body at a position which lies over a suction channel of the sole plate.

5. A floor tool according to claim 3, wherein the connecting arm is pivotally mounted to the supporting body at a position which is substantially coincident with the pivotal axis of the sole plate.

6. A floor tool according to claim 1 or 2, wherein the connecting arm comprises a rigid member which provides mechanical connection between the outlet conduit and the supporting body and wherein the floor tool further comprises a flexible hose for carrying fluid flow between a suction outlet of the sole plate and the outlet conduit.

7. A floor tool according to claim 1 or 2, wherein the connecting arm is arranged to carry fluid flow between a suction outlet of the sole plate and the outlet conduit.

8. A floor tool according to claim 1 or 2, further comprising a skirt for riding along the floor surface during hard floor cleaning, and wherein the sole plate is movable between a working position, in which the sole plate is lower than the skirt and a stored position in which the sole plate is higher than the skirt.

9. A floor tool according to claim 1 or 2, further comprising a valve for admitting bled air from the atmosphere into the floor tool, wherein the valve is manually adjustable such that a user of the cleaning head can select the amount of bled air.

10. A floor tool according to claim 1 or 2, wherein the supporting body has a channel for receiving the connecting arm.

11. A floor tool according to claim 10, wherein the connecting arm is dimensioned such that, when the connecting arm lies alongside the supporting body, the pivotal connection between the first end of the connecting arm and the outlet conduit lies within the channel on the supporting body.

12. A floor tool according to claim 10, wherein the at least one wheel or roller is mounted on each side of the channel.

13. A floor tool according to claim 1 or 2, further comprising a stop limiting movement of the connecting arm in a direction away from the supporting body.

14. A floor tool according to claim 13, wherein the supporting body has a channel for receiving the connecting arm and the stop means acts between the connecting arm and at least one side of the channel.

15. A floor tool for use in vacuum cleaning floor surfaces, comprising:

a sole plate for engaging with a floor surface, a supporting body for the sole plate having a wheel or roller thereon for allowing the body to ride along the floor surface, an outlet conduit for coupling to a wand of a vacuum cleaner, and a connecting arm for connecting the outlet conduit to the supporting body, a first end of the connecting arm being pivotally connected to the outlet conduit about a first pivotal axis, the second end of the connecting arm being pivotally connected to the supporting body about a second pivotal axis, the first and second pivotal axes being substantially parallel to one another, and the connecting arm being pivotable between lowered and raised positions, wherein a portion of the connecting arm is located between the second axis and the wheel or roller on the supporting body.

* * * * *

UNITED STATES PATENT AND TRADEMARK OFFICE

CERTIFICATE OF CORRECTION

PATENT NO. : 7,367,085 B2
APPLICATION NO. : 10/494294
DATED : May 6, 2008
INVENTOR(S) : Alastair Gordon Anderson et al.

It is certified that error appears in the above-identified patent and that said Letters Patent is hereby corrected as shown below:

On the Title page, under Item (75) Inventors, the order of the inventors listed should read as follows:

--Alastair Gordon Anderson, Munich (DE);

Martin Paul Bagwell, Andover (GB)--

Signed and Sealed this

Fifteenth Day of July, 2008

JON W. DUDAS
*Director of the United States Patent and Trademark Office*